US009486758B2

(12) United States Patent
Yang

(10) Patent No.: US 9,486,758 B2
(45) Date of Patent: Nov. 8, 2016

(54) APPARATUS FOR PRODUCING COMPOSITE GAS FOR FABRICATING METAL MATRIX COMPOSITE MATERIALS IN LIQUID METAL PROCESS

(71) Applicant: Young Sek Yang, Anyang-si (KR)

(72) Inventor: Young Sek Yang, Anyang-si (KR)

(73) Assignee: FOOSUNG PRECISION IND., CO., LTD., Hwaseong-Si, Gyeongg-Do (KR)

( * ) Notice: Subject to any disclaimer, the term of this patent is extended or adjusted under 35 U.S.C. 154(b) by 581 days.

(21) Appl. No.: 14/147,812

(22) Filed: Jan. 6, 2014

(65) Prior Publication Data

US 2016/0101392 A1 Apr. 14, 2016

(30) Foreign Application Priority Data

Jan. 11, 2013 (KR) ..... 10-2013-0003224

(51) Int. Cl.

| | |
|---|---|
| ***B01F 7/00*** | (2006.01) |
| ***B01F 7/16*** | (2006.01) |
| ***B01F 3/12*** | (2006.01) |
| ***B01F 13/02*** | (2006.01) |
| ***C22C 1/10*** | (2006.01) |

(52) U.S. Cl.

CPC ..... *B01F 13/0211* (2013.01); *B01F 3/1221* (2013.01); *B01F 7/007* (2013.01); *C22C 1/10* (2013.01); *B01F 7/1665* (2013.01); *B01F 2003/125* (2013.01)

(58) Field of Classification Search

CPC ..... B01F 3/06; B01F 13/0211; B01F 7/16; B01F 7/1665; B01F 3/1221; C22C 1/00

See application file for complete search history.

(56) References Cited

U.S. PATENT DOCUMENTS

| | | | | | |
|---|---|---|---|---|---|
| 3,024,500 | A * | 3/1962 | Lawson | B01F 13/0211 | 19/145.5 |
| 3,134,576 | A * | 5/1964 | Lucke | B01F 7/00925 | 241/280 |
| 3,298,792 | A * | 1/1967 | Di Drusco | B01F 13/0211 | 159/DIG. 3 |
| 3,671,296 | A * | 6/1972 | Funakoshi et al. | A61J 3/005 | 118/500 |
| 3,913,847 | A * | 10/1975 | Glatt | B01J 2/16 | 241/46.04 |
| 3,945,922 | A * | 3/1976 | Jagusch | B01F 3/04 | 210/195.1 |
| 3,998,433 | A * | 12/1976 | Iwako | B01F 7/00758 | 366/178.3 |
| 4,323,312 | A * | 4/1982 | Glatt | B01J 2/16 | 34/364 |
| 4,511,093 | A * | 4/1985 | Ohkoshi | B01F 7/00 | 241/101.8 |

(Continued)

FOREIGN PATENT DOCUMENTS

KR 20030070323 A 8/2003

*Primary Examiner* — Tony G Soohoo

(74) *Attorney, Agent, or Firm* — Egbert Law Office, PLLC

(57) ABSTRACT

Disclosed is an apparatus for producing composite gas used for fabricating nanocomposite materials. The apparatus includes a pressure tank having a housing, which has an internal space and an upper opening, and a closing cap opening or closing the opening, a carrier mounted below the housing, a gas supply supplying inert gas into the pressure tank, a powder supply mounted to the closing cap to supply nano-powders into the pressurized inert gas tank, an exhaust part discharging the inert gas containing nano-powders supplied into the pressure tank, an upper rotor disposed to the inner side of the closing cap, and a lower fan mounted at a lower portion of the housing.

4 Claims, 9 Drawing Sheets

(56) References Cited

U.S. PATENT DOCUMENTS 4,534,653 A * 8/1985 Courtay ..... B01F 13/0288 222/195
4,556,175 A * 12/1985 Motoyama ..... B01J 2/16 241/282.1
4,623,098 A * 11/1986 Motoyama ..... B01J 2/10 241/46.04
4,724,794 A * 2/1988 Itoh ..... B01J 2/003 118/19
4,736,895 A * 4/1988 Huttlin ..... A23G 3/2084 241/40
4,772,193 A * 9/1988 Glatt ..... B01J 2/14 23/313 FB
4,967,688 A * 11/1990 Funakoshi ..... B01J 8/382 118/303
4,981,365 A * 1/1991 Bow ..... B01F 15/0201 366/139
4,983,046 A * 1/1991 Murata ..... B01F 7/00008 241/199.12
5,018,671 A * 5/1991 Tanimoto ..... C11D 17/065 241/16
5,030,400 A * 7/1991 Danielsen ..... B01J 2/00 118/303
5,056,926 A * 10/1991 Bouheben ..... B01F 7/00166 366/102
5,284,678 A * 2/1994 Hirschfeld ..... B01J 2/006 118/303
5,296,265 A * 3/1994 Okuma ..... B01J 2/006 118/303
5,429,825 A * 7/1995 Reo ..... A61K 9/1694 424/490
5,507,871 A * 4/1996 Morino ..... B01J 2/003 118/52
5,582,643 A * 12/1996 Takei ..... A23P 1/022 118/19
5,720,439 A * 2/1998 Nakazawa ..... B01J 2/14 241/21
5,865,538 A * 2/1999 Walker ..... B01F 7/1695 366/197
5,904,951 A * 5/1999 Yamanaka ..... A23G 3/26 118/19
5,908,240 A * 6/1999 Hood ..... B01F 7/22 366/114
6,042,033 A * 3/2000 Sugimoto ..... B01F 7/162 241/101.2
6,227,697 B1 * 5/2001 Stahl ..... B01F 7/1665 366/288
6,264,989 B1 * 7/2001 Kato ..... A23L 1/22008 424/439
6,270,801 B1 * 8/2001 Walter ..... B01J 2/14 424/458
6,354,728 B1 * 3/2002 Bretschneider ..... A01C 1/06 366/286
6,508,423 B2 * 1/2003 Gloor ..... B01F 7/1605 241/101.8
6,745,960 B1 * 6/2004 Myo ..... B01J 2/14 241/18
2003/0227817 A1 * 12/2003 Martel ..... B01D 19/0063 366/142
2004/0097623 A1 * 5/2004 Koeda ..... B01F 7/00383 524/237
2004/0234677 A1 * 11/2004 Sato ..... B01F 7/00208 427/11
2005/0213428 A1 * 9/2005 Freude ..... B01F 7/162 366/273
2007/0139442 A1 * 6/2007 Robinson ..... B01F 7/162 345/629
2008/0181050 A1 * 7/2008 Basten ..... B01F 3/18 366/102
2008/0245265 A1 * 10/2008 Corbelli ..... B01F 3/1221 106/31.9
2013/0186834 A1 * 7/2013 Vicalvi ..... G01N 30/56 210/656
2013/0315030 A1 * 11/2013 Ishida ..... B01F 3/1221 366/153.3
2013/0316077 A1 * 11/2013 Dassel ..... B01J 8/1809 427/213
2015/0118753 A1 * 4/2015 Brau ..... B01F 13/0272 435/394

* cited by examiner

APPARATUS FOR PRODUCING COMPOSITE GAS FOR FABRICATING METAL MATRIX COMPOSITE MATERIALS IN LIQUID METAL PROCESS

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates, in general, to an apparatus for producing composite gas for fabricating metal matrix composite materials (MMCMs) in a liquid metal process and, more particularly, to an apparatus by which composite gas, which is used to fabricate nanoparticle reinforced metal matrix, composite materials, is produced by feeding nano-powders into a pressurized inert gas tank, in which upper rotor and lower fans are mounted, blowing and dispersing the nano-powders around the inside of the pressure tank with rotation of upper and lower blades, and supplying the dispersed nano-powders with inert gas to molten metal by a lance pipe or agitation rotor, which will be fed to a liquid metal mixing process in fabricating composite materials, thereby fundamentally solving the problem that nano-powders are not uniformly dispersed, but agglomerated into clusters during the feeding process, and enabling development of a new process using the composite gas containing well-dispersed nano-powders in inert gas.

2. Description of Related Art Including Information Disclosed Under 37 CFR 1.97 and 37 CFR 1.98

Recently, automobile and aviation industries are putting a great deal of effort into developing composite materials using nano-sized ceramic powders, carbon nanotubes (CNTs) and carbon nanofibers (CNFs) in order to develop materials that have excellent mechanical properties and lighter weight compared to those of existing materials.

However, there is no solution to effectively solve the problem of agglomeration or clustering of nano-powders in the fabrication of metal matrix composite materials in a liquid metal process, thereby creating a problematic situation for improving dispersion and wetting of nano-powders in liquid metal and developing an efficient process because of a limited feeding method of nano-powders to molten metal.

Although until now, agglomerated or clustered nano-powders are dispersed using high shear stress obtained by mechanical agitation or by using ultrasonic waves in a liquid metal process, satisfactory results have not yet been obtained.

Further, in regard to development of new fabrication processes, a special effect has not yet been obtained because of the limited feeding method of nano-powders. For example, although, in the case of metal matrix nanocomposites (MMNC), a stir casting process is generally used for fabricating metal matrix composite materials in a liquid metal process, such a method is not yet complete because it is difficult to disperse nano-powders without agglomeration and clusters in the molten metal.

Therefore, there is a need to develop a new process of feeding nano-powders used to manufacture composite materials, with excellent dispersion and wettability in molten metal, without using excessive mechanical agitation and expensive ultrasonic equipment, and thus to develop a variety of manufacturing processes for composite materials using such a method.

BRIEF SUMMARY OF THE INVENTION

Accordingly, the present invention has been made keeping in mind the above problems occurring in the related art, and the present invention is intended to propose to an apparatus by which composite gas, which is used to fabricate nanoparticle reinforced metal matrix composite materials, is produced by feeding nano-powders into a pressurized inert gas tank, in which upper rotor and lower fans are mounted, blowing and dispersing the nano-powders around the inside of the pressure tank with rotation of upper and lower blades, and supplying well-dispersed nano-powders with inert gas to molten metal by a lance pipe or agitation rotor, which will be fed to a liquid metal mixing process in fabricating composite materials, thereby fundamentally solving the problem that nano-powders are not uniformly dispersed, but agglomerated into clusters during the feeding process, and enabling development of a new process using the composite gas containing well dispersed nano-powders in inert gas.

In order to achieve the above object, according to one aspect of the present invention, there is provided an apparatus for producing composite gas used for fabricating composite materials, the apparatus including: a pressure tank having a housing, which has an internal space and an upper opening, and a closing cap opening or closing the opening; a carrier mounted below the housing; a gas supply supplying inert gas into the pressure tank, a powder supply mounted to the closing cap to supply nano-powders into the pressure tank; an exhaust part discharging the inert gas containing nano-powders supplied into the pressure tank; an upper rotor disposed to the inner side of the closing cap; and a lower fan mounted at a lower portion of the housing.

The lower fan may include a lower dispersing motor mounted at the lower portion of the housing such that a lower rotary shaft thereof is disposed to the inner side of the housing; and a lower blade mounted at an end of the lower rotary shaft, and the upper rotor may include an upper dispersing motor mounted at an upper portion of the closing cap such that an upper rotary shaft thereof is disposed to the inner side of the closing cap, and an upper blade mounted at an end of the upper rotary shaft.

The apparatus may further include an inclined guide panel in the housing so as to guide nano-powders therealong, the inclined guide panel being mounted at the lower portion of the inside of the housing, having a conical shape inclined downwards, and having a central guide hole through which the lower blade is disposed.

The bottom of the housing may have a concave shape on which falling nano-powders are guided to the center thereof.

The carrier may include a plurality of downwardly-curved support legs mounted on an outer surface of the housing, a plurality of connection rods connecting the support legs together, and a plurality of caters mounted to lower portions of the support legs.

Using the apparatus according to the present invention, composite gas, which is used to fabricate nanoparticle reinforced metal matrix composite materials, is produced by feeding nano-powders into a pressurized inert gas tank, in which upper rotor and lower fans are mounted, diffusing and dispersing the nano-powders around the inside of the pressure tank with rotation of upper and lower blades, and supplying the dispersed nano-powders with inert gas to produce composite materials, which will be led to a liquid metal mixing process in fabricating composite materials, thereby fundamentally solving the problem that nano-powders are not uniformly dispersed, but agglomerated into clusters during the feeding process, and enabling development of a new process using the composite gas containing well dispersed nano-powders in inert gas.

BRIEF DESCRIPTION OF THE SEVERAL VIEWS OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
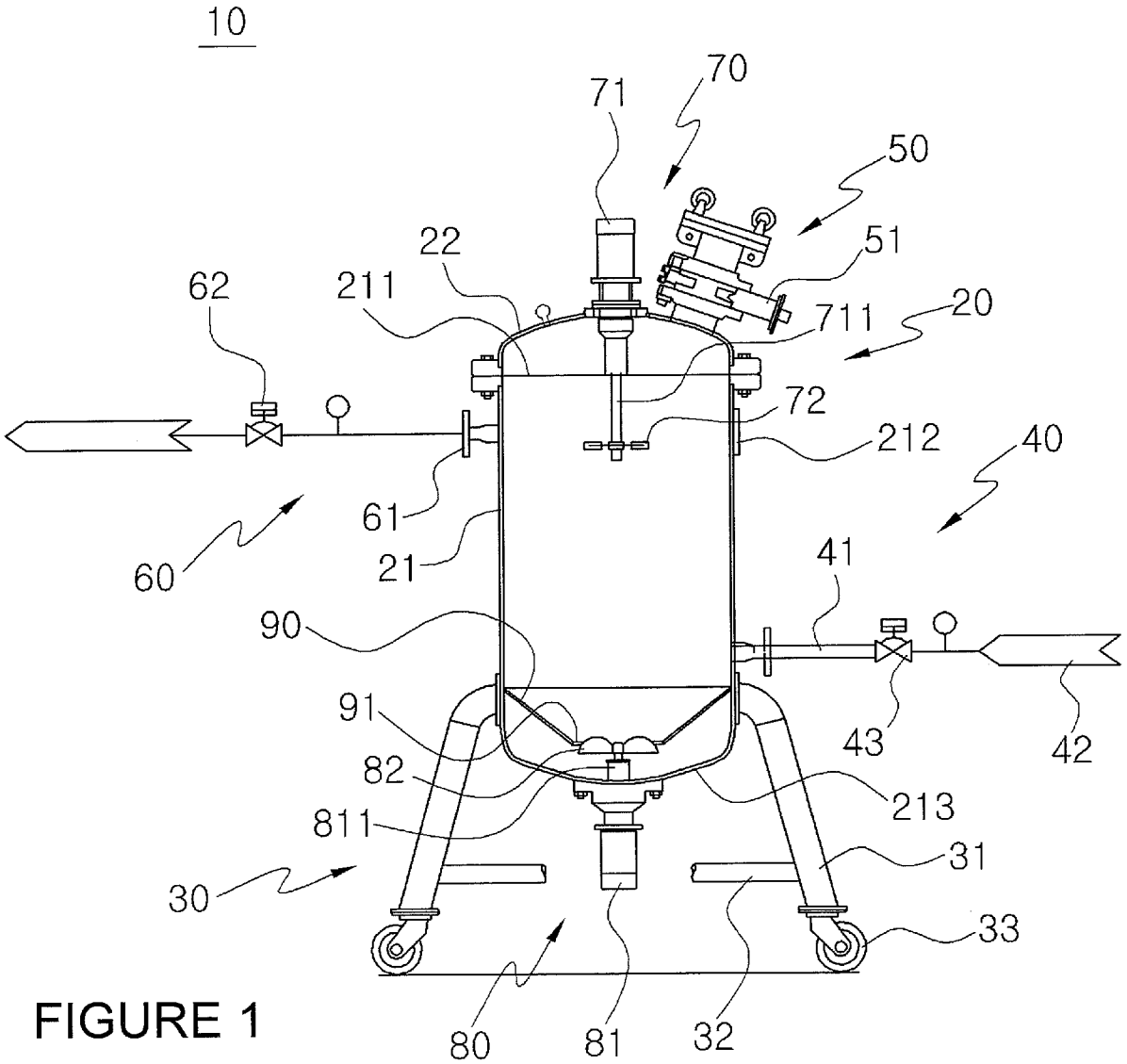
FIG. 1 is a sectional view showing an apparatus for producing composite gas used for fabricating nanoparticle reinforced metal matrix composite materials according to an embodiment of the present invention.

Reference will now be made in greater detail to a preferred embodiment of the invention, an example of which is illustrated in the accompanying drawings. In the embodiment, it should be understood that the line thickness, size or the like of the elements shown in the drawings may be exaggeratedly drawn to provide for clarity and convenience in describing the present invention. The terminology used herein is defined taking account of functions of elements in the present invention, so the definition can vary according to a user's or operator's intensions or practices. Therefore, the definition of the terminology should be determined with reference to contents throughout this specification.

Further, the embodiments below do not limit the scope of the present invention, but present merely illustrative examples, so there may be a variety of embodiments that are realized according to the technical spirit of the present invention.

Figure 2A:
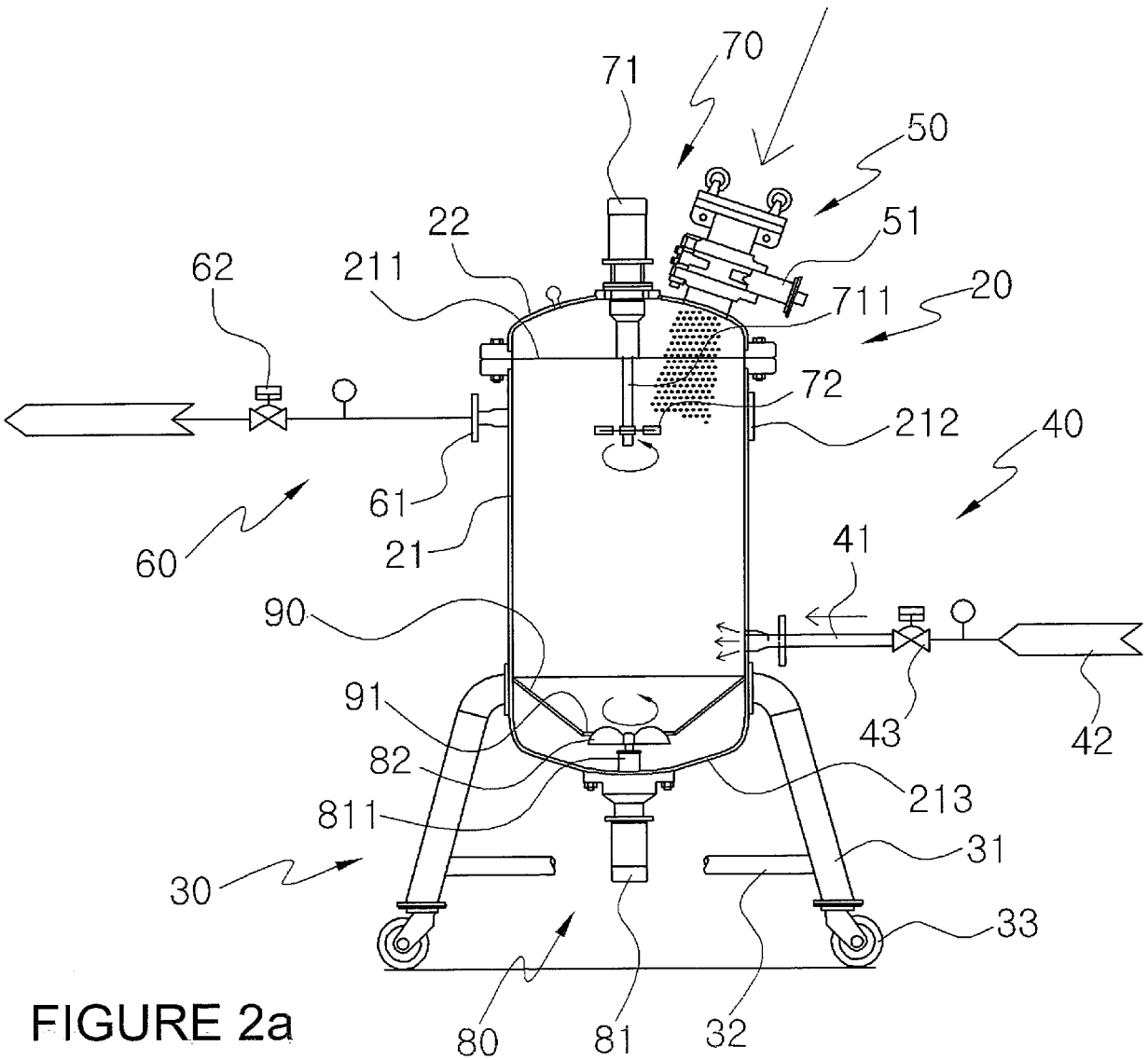
FIGS. 2A to 2C are views showing the operation of the apparatus of the present invention.
Figure 2B:
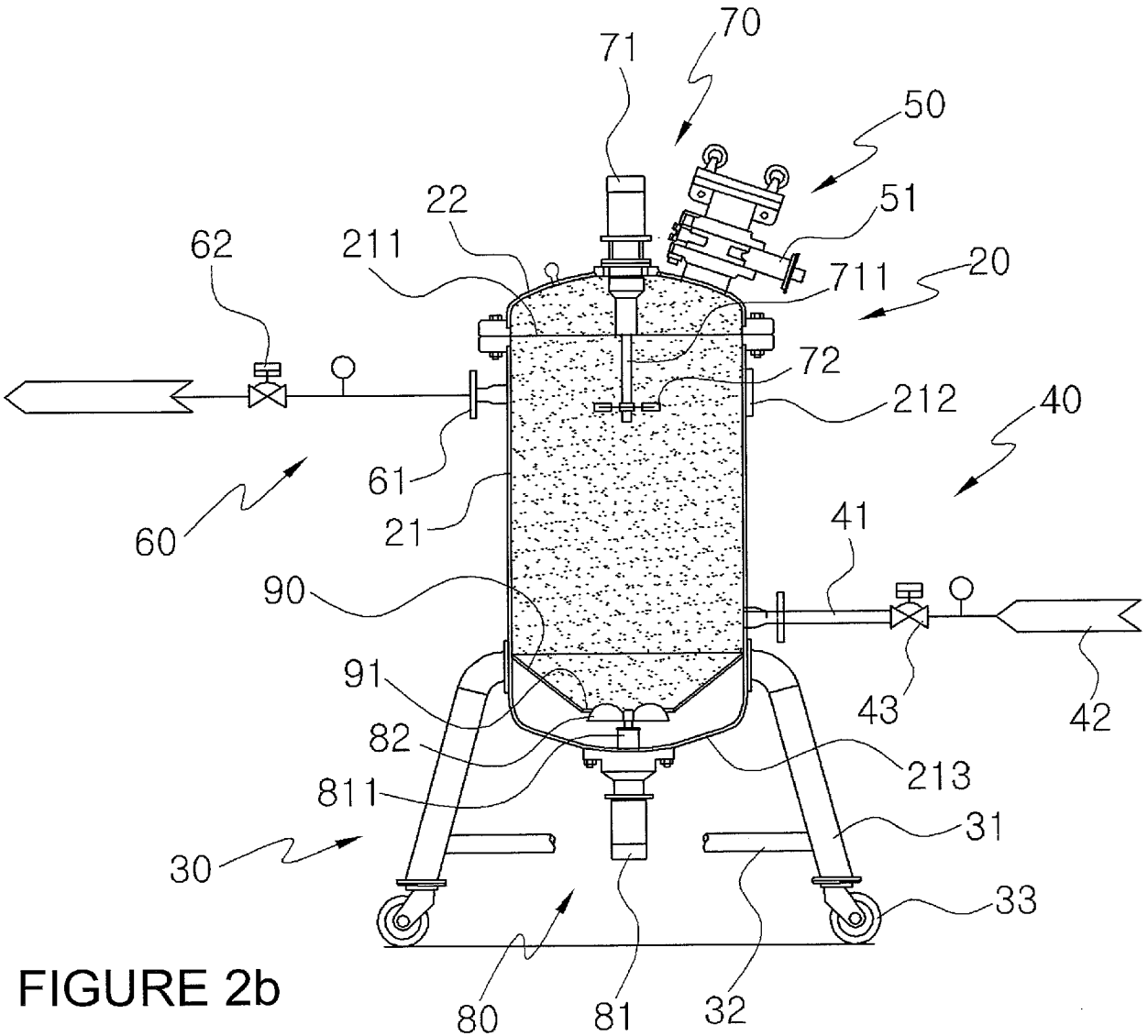
Figure 2C:
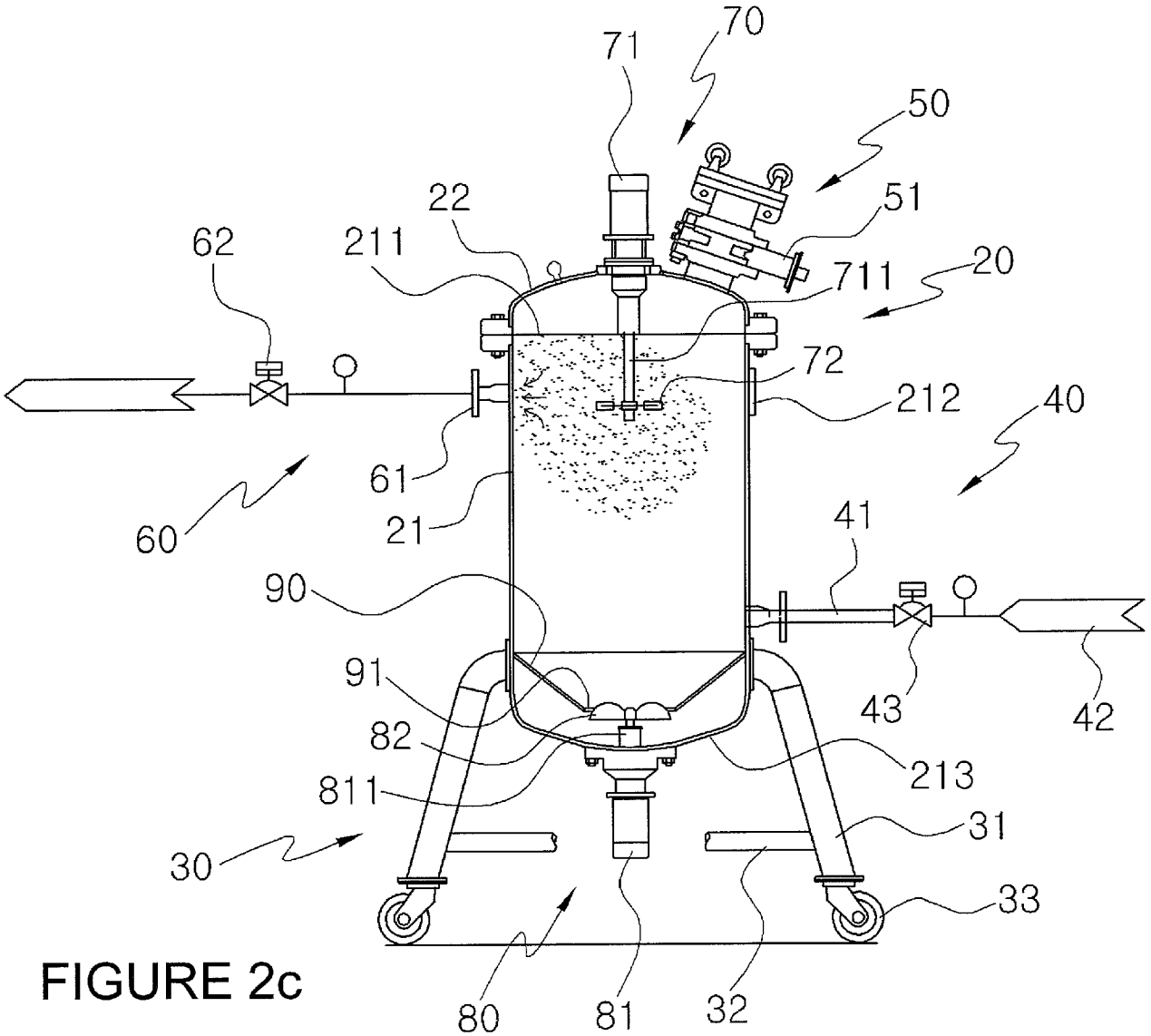
Figure 3A:
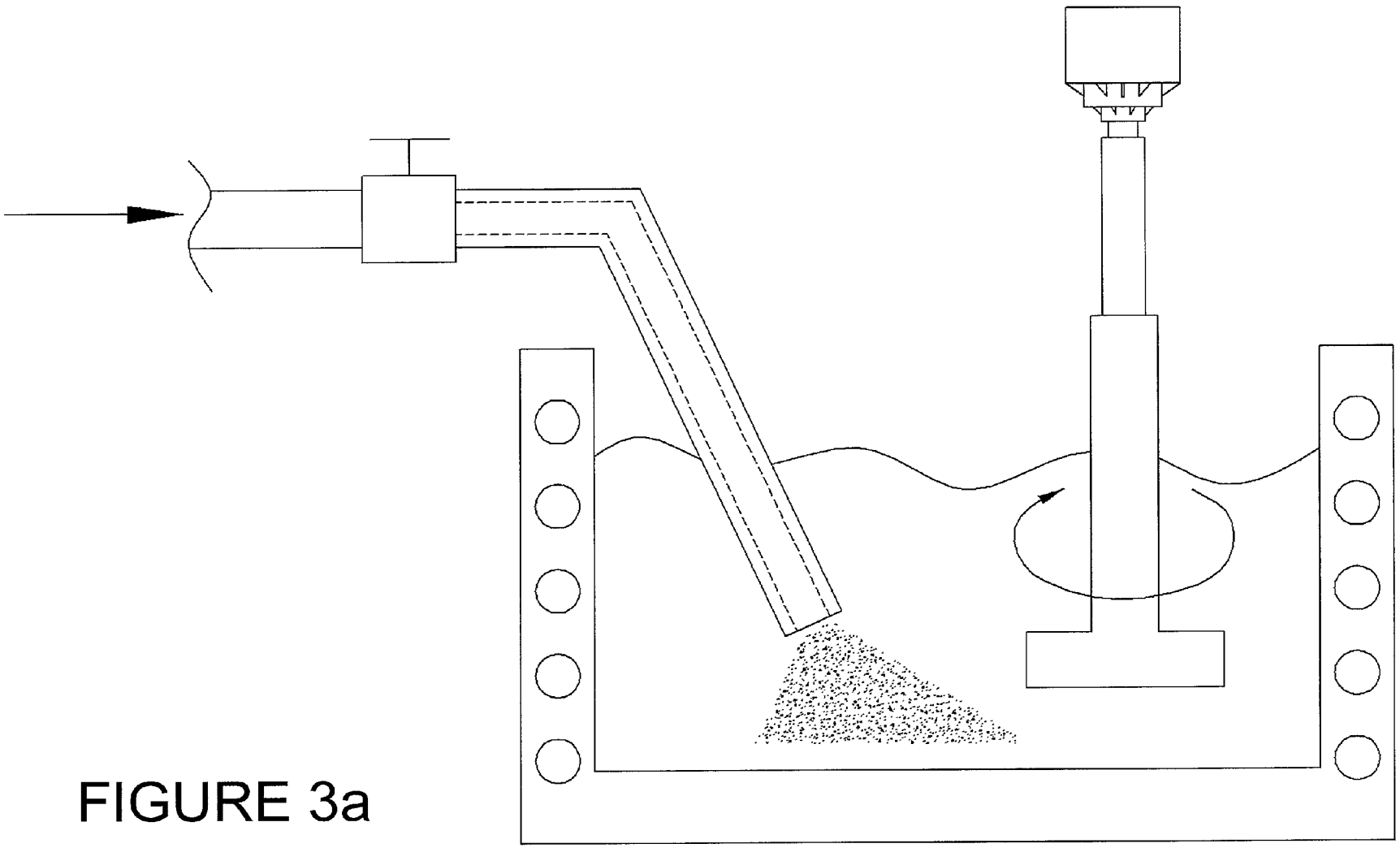
FIGS. 3A and 3B are views showing exemplary use of the composite gas produced by the apparatus of the present invention.
Figure 3B:
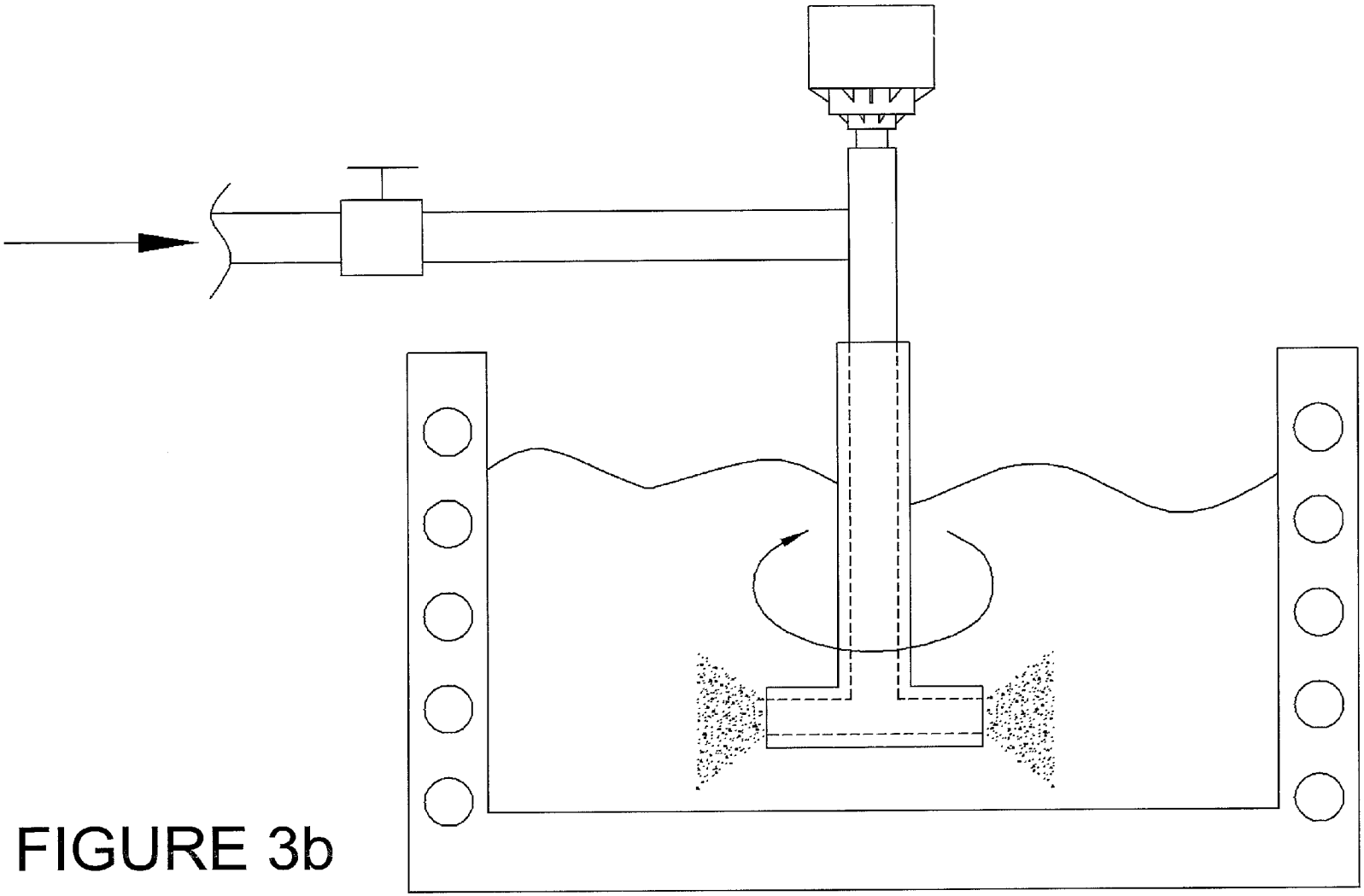
Figure 4A:
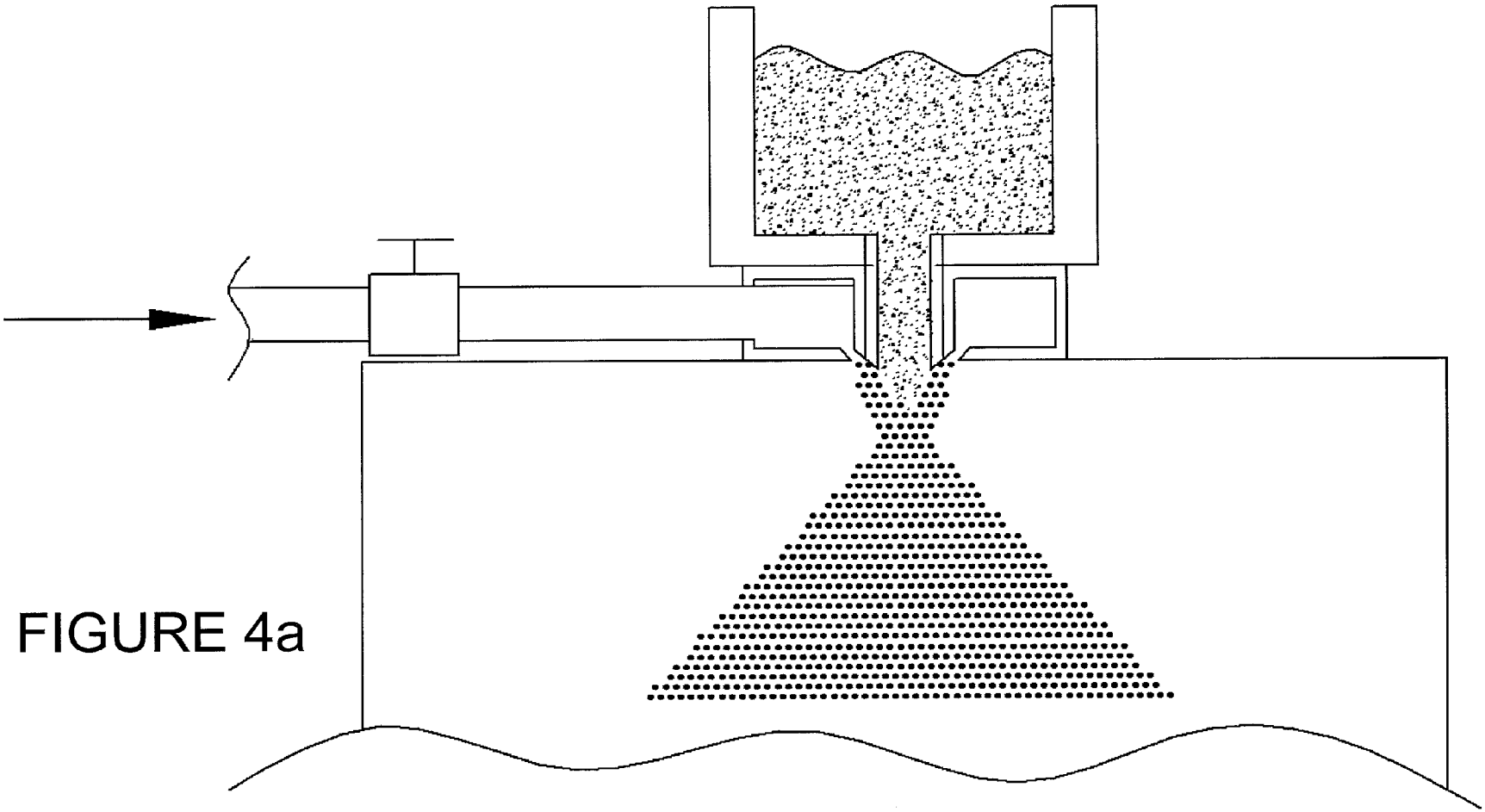
FIGS. 4A to 4C are views showing other exemplary use of the composite gas produced by the apparatus of the present invention.
Figure 4B:
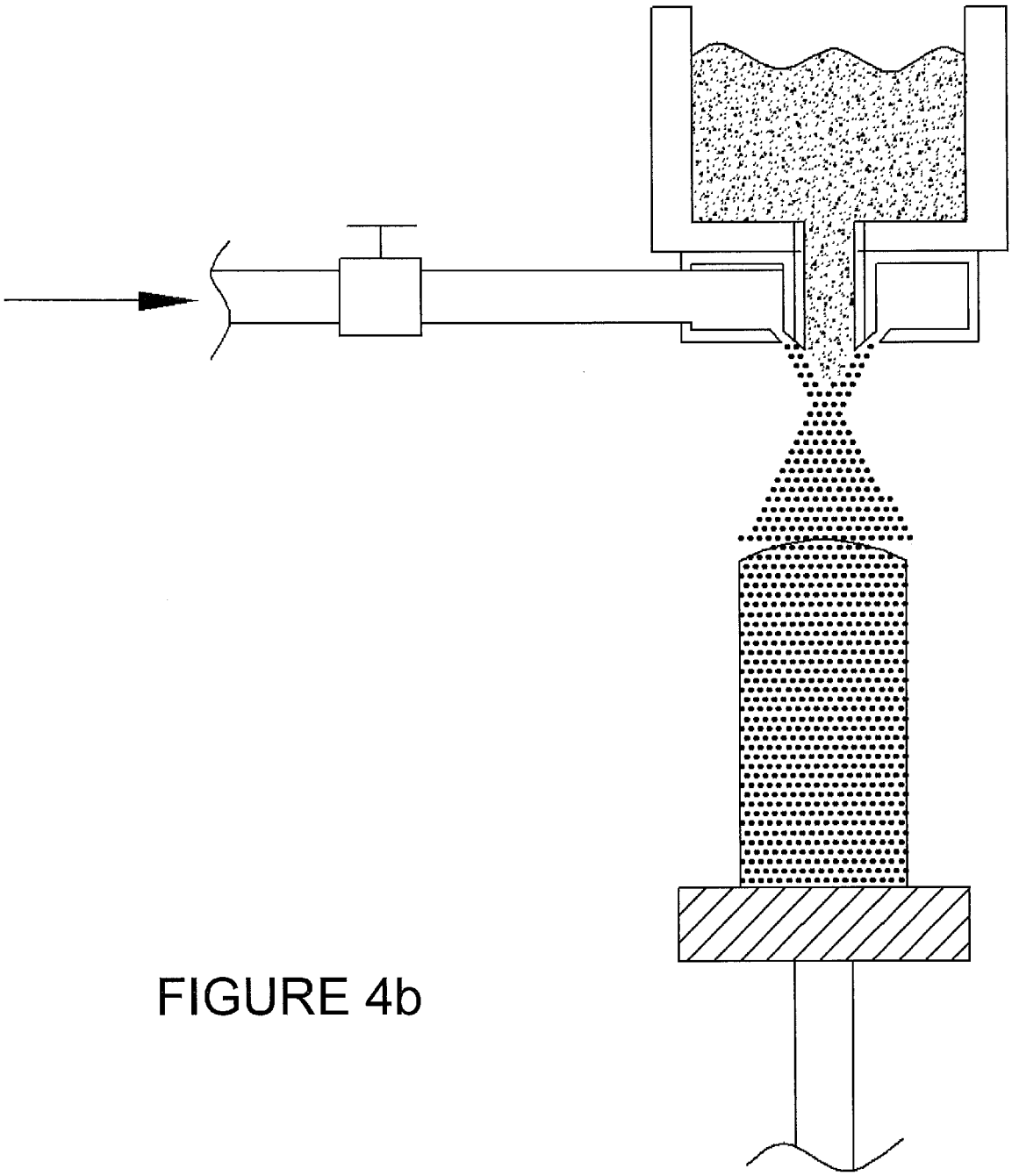
Figure 4C:
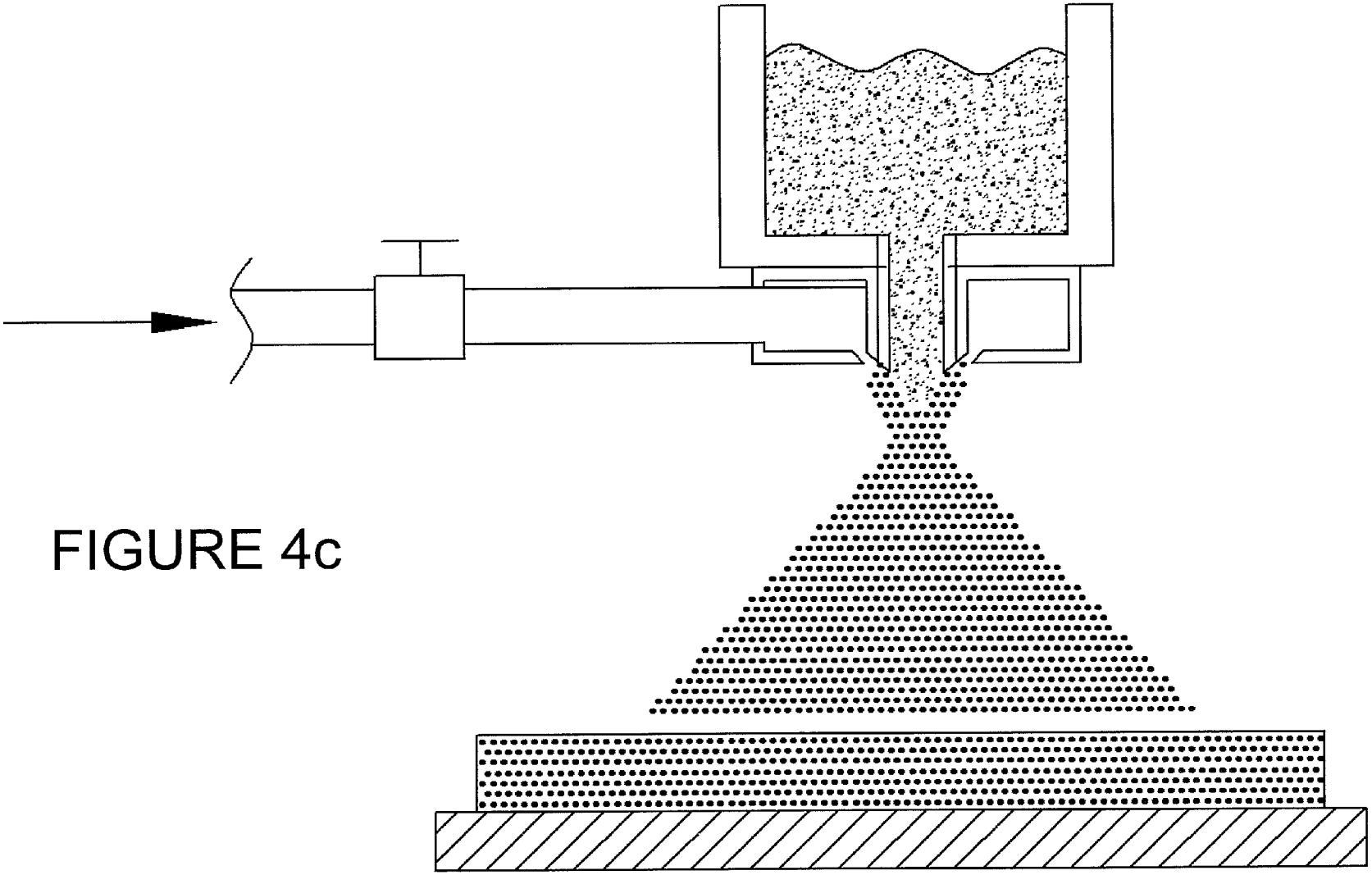

FIG. 1 is a sectional view showing an apparatus for producing composite gas used for fabricating nanocomposite materials according to an embodiment of the present invention, FIGS. 2A to 2C are views showing the operation of the apparatus of the present invention, FIGS. 3A and 3B are views showing exemplary use of the composite gas produced by the apparatus of the present invention, and FIGS. 4A to 4C are views showing other exemplary use of the composite gas produced by the apparatus of the present invention.

As shown in the figures, the apparatus 10 for producing composite gas used for fabricating nanocomposite materials (referred hereinafter to as an 'apparatus') produces composite gas, which is produced by diffusing and dispersing a nano-powder into inert gas introduced into the apparatus, and discharging it to the outside. The apparatus 10 includes a pressure tank 20, a carrier 30, a gas supply 40, a powder supply 50, an exhaust part 60, an upper rotor 70, and a lower fan 80.

The pressure tank 20 has a vessel-type metal housing 21 which has an internal space and an upper opening 211, and a convex closing cap 22 which is hinge-coupled to an upper portion of the housing 21 so as to open or close the opening 211.

Here, the housing 21 is further provided with a sight window through which the operation in the housing is checked from the outside, and the closing cap 22 is further provided with a barometer to measure an internal pressure of the pressure tank 20.

The carrier 30 is mounted below the housing 21 so as to carry the pressure tank 20. The carrier 30 includes a plurality of downwardly-curved support legs 31 of which upper ends are fixedly welded to an outer surface of the housing 21, a plurality of connection rods 21 which fixedly connect the support legs 31 together by means of welding, and a plurality of caters 33 which are mounted to lower portions of the support legs 31.

The gas supply 40 serves, to supply pressurized inert gas into the pressure tank 20, and includes a supply pipe 41 which is mounted to the lower portion of the housing 21 in a communication manner, a gas tank 42 from which gas is supplied to the supply pipe 41, and a gas control valve 43 which is provided to the supply pipe 41.

The powder supply 50 is mounted to the closing cap 22 so as to supply nano-powders into the housing. The powder supply 50 is composed of a piping structure to communicate with the inside of the housing, and has a valve 51 through which external supply of nano-powders into the housing is controlled.

The exhaust part 60 serves to discharge a composite gas, which is produced by mixing the inert gas with nano-powders supplied into the pressure tank 20, to the outside. The exhaust part includes an exhaust pipe 61 which is mounted to the upper portion of the housing 21 in a communication manner, and an exhaust control valve 62 which is mounted to the exhaust pipe 61. A transfer pipe is connected to the exhaust pipe 61 so that the composite gas in which inert gas and nano-powders are mixed together is supplied to molten metal with agitation system through the lance pipe from the exhaust pipe as shown in FIGS. 3A and 3B or FIGS. 4A to 4C.

The upper mixer 70 is mounted to the closing cap 22 so as to move down nano-powders, which are introduced therethrough, while dispersing them. The upper mixer 70 includes an upper dispersing motor 71 which is mounted at an upper portion of the closing cap 22 such that an upper rotary shaft 711 thereof is disposed to the inner side of the closing cap 22, and an upper blade 72 which is mounted at an end of the upper rotary shaft 711.

The lower fan 80 serves to lift nano-powders, which are supplied into the housing and fail by weight or are blown down by the upper mixer 70, while dispersing the nano-powders. The lower fan 80 includes a lower dispersing motor 81 which is mounted at the lower portion of the housing 21 such that a lower rotary shaft 811 thereof is disposed to the inner side of the housing 21, and a lower blade 82 which is mounted at an end of the lower rotary shaft 811.

Here, an inclined guide panel 90 is further provided in the housing 21 so as to guide nano-powders therealong. The inclined guide panel 90 has a downwardly inclined conical body which has an edge portion fixedly welded to a lower portion of an inner side of the housing 21, and a central guide hole 91 through which the lower blade 82 is disposed. That is, falling nano-powders are guided, along the upper surface of the guide panel 90, towards the guide hole 91 where nano-powders are dispersed upwards by the lower mixer 80. Here, the lower blade 82 is preferably disposed below the guide hole 91, possibly fitted into the guide hole 91.

In addition, the bottom 213 of the housing 21 has a concave shape on which falling nano-powders are guided to the center thereof. That is, nano-powders falling through the guide hole 91 are collected at the center along the concave surface of the bottom of the housing, so that nano-powders then are swirled up by rotation of the lower blade 82 towards the upper portion of the housing through the guide hole 91.

The operation of the apparatus will now be described. First, after a predetermined amount of nano-powders Is introduced into the powder supply 50 with the opening 211 of the housing 21 closed by the closing cap, the powder supply is closed and at the same time, inert gas is supplied into the pressure tank through the gas supply 40, and then the lower and upper blades 81 and 71 are operated to drive the lower and upper blades 82 and 72.

Thereby, the nano-powders are uniformly dispersed around the inside of the pressurized inert gas tank 20 by the lower and upper blades 82 and 72 that are rotating, and the nano-powders dispersed together with inert gas are discharged to the outside through the exhaust part 60, and finally the exhaust part 60 and the gas supply 40 are closed. Subsequently, the above-mentioned nano-powder-supplying process is repeated.

Although a preferred embodiment of the present invention has been described for illustrative purposes, those skilled in the art will appreciate that various modifications, additions and substitutions are possible, without departing from the scope and spirit of the invention as disclosed in the accompanying claims.

I claim:

1. An apparatus for producing composite gas used for fabricating nanocomposite materials, the apparatus comprising:

a pressure tank having a housing, the pressure tank having an internal space and an upper opening, and a cap that opens or closes the upper opening;

a carrier mounted below the housing;

a gas supply that supplies inert gas into the pressure tank;

a powder supply mounted to the cap to supply nano-powders into the pressure tank;

an exhaust part discharging the inert gas containing nano-powders supplied into the pressure tank;

an upper rotor disposed onto an inner side of the cap;

a lower fan mounted at a lower portion of the housing an inclined guide panel in the housing so as to guide the nano-powders therealong, the inclined guide panel being mounted at a lower portion of an inside of the housing, the inclined guide panel having a conical shape inclined downwards and having a central guide hole through which a lower blade is disposed.

2. The apparatus of claim 1, wherein the lower fan includes a lower dispersing motor mounted at the lower portion of the housing such that a lower rotary shaft thereof is disposed to the inner side of the housing, said fan having a lower blade mounted at an end of the lower rotary shaft the apparatus further comprising:

an upper mixer having an upper dispersing motor mounted at an upper portion of the cap such that an upper rotary shaft thereof is disposed to the inner side of the cap, said upper mixer having an upper blade mounted at an end of the upper rotary shaft.

3. The apparatus of claim 1, wherein a bottom of the housing has a concave shape on which falling nano-powders are guided to a center thereof.

4. The apparatus of claim 1, wherein the carrier comprises:

a plurality of downwardly-curved support legs mounted on an outer surface of the housing;

a plurality of connection rods connecting the support legs together; and a plurality of caters mounted to lower portions of the support legs.

* * * * *